US007607590B2

(12) United States Patent
Nies

(10) Patent No.: US 7,607,590 B2
(45) Date of Patent: Oct. 27, 2009

(54) OSCILLATING SPRINKLER WITH ADJUSTABLE SPRAY WIDTH

(75) Inventor: Juergen Nies, Winchester, VA (US)

(73) Assignee: Melnor, Inc., Winchester, VA (US)

( * ) Notice: Subject to any disclaimer, the term of this patent is extended or adjusted under 35 U.S.C. 154(b) by 66 days.

(21) Appl. No.: 11/844,620

(22) Filed: Aug. 24, 2007

(65) Prior Publication Data

US 2008/0054103 A1 Mar. 6, 2008

Related U.S. Application Data

(60) Provisional application No. 60/841,243, filed on Aug. 31, 2006.

(51) Int. Cl.

| | |
|---|---|
| ***B05B 3/06*** | (2006.01) |
| ***B05B 3/16*** | (2006.01) |
| ***B05B 3/00*** | (2006.01) |
| ***B05B 15/00*** | (2006.01) |
| ***F23D 14/48*** | (2006.01) |
| ***B05B 1/20*** | (2006.01) |

(52) U.S. Cl. ..... 239/255; 239/242; 239/246; 239/248; 239/450; 239/548; 239/566

(58) Field of Classification Search ..... 239/242, 239/246, 247, 248, 253, 255, 450, 548, 550, 239/551, 566, DIG. 1

See application file for complete search history.

(56) References Cited

U.S. PATENT DOCUMENTS

| | | | | |
|---|---|---|---|---|
| 2,952,413 | A | 9/1960 | Jepson | |
| 3,498,543 | A | 3/1970 | Gilmour | |
| 3,559,888 | A | 2/1971 | Miklos | |
| 3,647,140 | A | 3/1972 | Perrot et al. | |
| 3,827,637 | A | 8/1974 | Stephany et al. | |
| 3,854,665 | A | 12/1974 | Rodgers | |
| 4,905,903 | A | 3/1990 | Katzer et al. | |
| 5,033,678 | A | 7/1991 | Borghese et al. | |
| 5,305,956 | A | 4/1994 | Wang | |
| 5,350,115 | A * | 9/1994 | Burnworth et al. | 239/242 |
| 5,526,982 | A | 6/1996 | McKenzie | |
| 5,645,218 | A * | 7/1997 | Heren et al. | 239/242 |
| 5,657,928 | A * | 8/1997 | Jian | 239/242 |

(Continued)

FOREIGN PATENT DOCUMENTS

| | | |
|---|---|---|
| DE | 354 983 | 6/1922 |

(Continued)

OTHER PUBLICATIONS

Search Report issued in corresponding European Application No. 07405258.0-2425 dated Nov. 27, 2007, In English.

*Primary Examiner*—Len Tran
*Assistant Examiner*—Justin Jonaitis
(74) *Attorney, Agent, or Firm*—Westerman, Hattori, Daniels & Adrian, LLP

(57) ABSTRACT

An adjustable oscillating sprinkler with a rectangular shaped frame having a generally tubular shaped housing rotatably attached to said frame with a nozzle strip attached to the tubular housing, where the nozzle strip has a plurality of flexible nozzles, and the sprinkler also has a pivot plate in contact with the nozzle strip and the tubular housing, where an adjusting element rotates the pivot plate about a radius of its longitudinal axis thereby adjusting the coverage pattern of the sprinkler.

19 Claims, 17 Drawing Sheets

U.S. PATENT DOCUMENTS

| | | | | |
|---|---|---|---|---|
| 6,062,490 | A * | 5/2000 | Katzer et al. | 239/246 |
| 6,135,356 | A * | 10/2000 | Mitzlaff et al. | 239/1 |
| 7,284,714 | B1 * | 10/2007 | Wang et al. | 239/562 |
| 7,389,950 | B2 * | 6/2008 | Lo | 239/542 |

FOREIGN PATENT DOCUMENTS

| | | | |
|---|---|---|---|
| DE | 733 188 | | 3/1943 |
| DE | 1 926 735 | | 12/1970 |
| DE | 30 44 310 | A1 | 6/1982 |
| DE | 30 44 310 | C2 | 6/1982 |
| DE | 36 29 696 | A1 | 3/1988 |
| DE | 36 29 696 | C2 | 3/1988 |
| DE | 37 25 384 | A1 | 2/1989 |
| DE | 40 34 695 | A1 | 5/1991 |
| DE | 296 05 046 | U1 | 6/1996 |
| FR | 2 748 367 | A3 | 11/1997 |
| GB | 2 322 572 | A | 2/1998 |
| GB | 2 417 699 | A | 3/2006 |
| WO | 95/17262 | A2 | 6/1995 |
| WO | 95/17262 | A3 | 6/1995 |

* cited by examiner

OSCILLATING SPRINKLER WITH ADJUSTABLE SPRAY WIDTH

BACKGROUND OF THE INVENTION

The present invention relates to a novel adjustment structure of an oscillating lawn sprinkler, which is easily adjustable into different water-outgoing angles so as to achieve a variety of sprinkling patterns.

Many kinds of oscillating sprinklers are currently on the market. Such sprinklers generally comprise a base frame, oscillator, and a tubular element containing a plurality of holes through which water is discharged. The oscillator drives the tubular element to oscillate back and forth, thereby watering a desired area of lawn. Furthermore, the oscillatory angle of such sprinklers is often adjustable, providing a way for varying the sprinkling area in the vertical direction. Thus the area of lawn to be watered can be tailored to some extent.

U.S. Pat. No. 6,135,356 (the '356 patent) describes a conventional oscillating sprinkler, wherein nozzles may be adjusted through two independent levers in order to achieve a desired coverage pattern, so that when each lever is individually adjusted, the angle of some nozzles, with respect to other nozzles, changes.

Conventional sprinkler designs such as the '356 patent, include a slotted shiftable guide body with a plurality of slots to adjust flexible nozzles, where the slots remain parallel with each other and each slot faces in the same direction. The slotted guide body is shiftable transversely relative to an associated nozzle row and adjusted by multiple levers.

One problem with the conventional design described above is that adjusting the two levers to obtain the desired spray coverage can be cumbersome and tedious. Also, the conventional design utilizes multiple adjusting mechanisms, which lead to more parts, thereby increasing both the complexity of the design, and the manufacturing and assembling costs associated with the design.

Thus a need was felt for an oscillating sprinkler which can easily and quickly be adjusted using just a single adjusting means, along with lower manufacturing and assembly costs.

SUMMARY OF THE INVENTION

The adjustable lawn sprinkler is set to a defined sprinkling pattern using a single handed adjustment mechanism. The single adjustment mechanism allows for easier use in setting the desired spray pattern. Additionally, the single adjustment mechanism allows for a lower manufacturing and assembling cost.

The sprinkler uses a plurality of flexible tubes or nozzles in order to direct the fluid, typically water, outside of the sprinkler to the surface requiring watering. Some nozzle(s) may be fixed in a substantially upright direction while the other nozzles may be variable.

The sprinkler may include a nozzle strip having a plurality of flexible variable nozzles and one or more fixed nozzles. The variable nozzles in the nozzle strip may be manipulated by a pivot plate positioned between a tubular housing, which holds the nozzle strip, and a cover. The nozzle strip may be a single piece of flexible material such as rubber, or a rubber like compound. The variable nozzles should be flexible in order to facilitate movement of the variable nozzle axes to control the spray pattern of the fluid.

The nozzle strip may also be designed so that the axis of any individual nozzle is tilted a pre-determined angle according to its distance away from the center of the pivot plate. Manufacturing the nozzles with a designed tilt minimizes resistance when fluid is flowing through the nozzle, especially when the nozzle is adjusted to its maximum degree of tilt.

The nozzle strip may also be designed so that the further any variable nozzle is away from the center of the pivot plate, the more pre-tilted the nozzle is. One advantage to pre-tilting the nozzles in this manner is to ensure that as the nozzles move from their pre-tilted positions, the fluid within the nozzle does not suffer increased resistance due to the bending or kinking of the individual nozzle. This is especially true of the most outer nozzles as they move the most.

The pivot plate has a radius which allows it to fit with the radius of the outside diameter of the tubular housing. The pivot plate also contains a plurality of apertures (such as slots or grooves) in which the individual nozzles fit and protrude, or extend through.

Each of the grooves of the pivot plate may progressively flare outwards. For example, the groove or grooves closest to the center of the pivot plate may be substantially perpendicular to the longitudinal axis of the pivot plate and the adjacent grooves may be progressively be less perpendicular (flare outward) to the longitudinal axis of the pivot plate, as the grooves get further from the center of the pivot plate.

One advantage to flaring the grooves as they get further away from the center of the pivot plate is to produce a fan-like pattern of fluid coverage. In other words, each of the variable nozzles may move relative to one another so that, when adjusted, an outer variable nozzle will move in an outward direction more than an inner variable nozzle. As such, the coverage pattern of the water will be uniform and consistent, leaving no large gaps in the area covered.

Another aspect of the invention may include a wedge and notch design so that the pivot plate may be more easily moved into any of a number of fixed positions. The different fixed positions result in different spray patterns of the variable nozzles. On the bottom side of the pivot plate is located a small wedge. This wedge contacts and moves over a semicircular notch-shaped element. The wedge may be held in place in by a notch, but may also be moved with the application of the requisite force. The wedge and notch settings allow for a consistent and repeatable spray pattern to be set by the user.

BRIEF DESCRIPTION OF DRAWINGS

The present invention is illustrated by way of example and not limited in the figures of the accompanying drawings in which like references indicate similar elements.

DETAILED DESCRIPTION OF THE DRAWINGS

Figure 1:
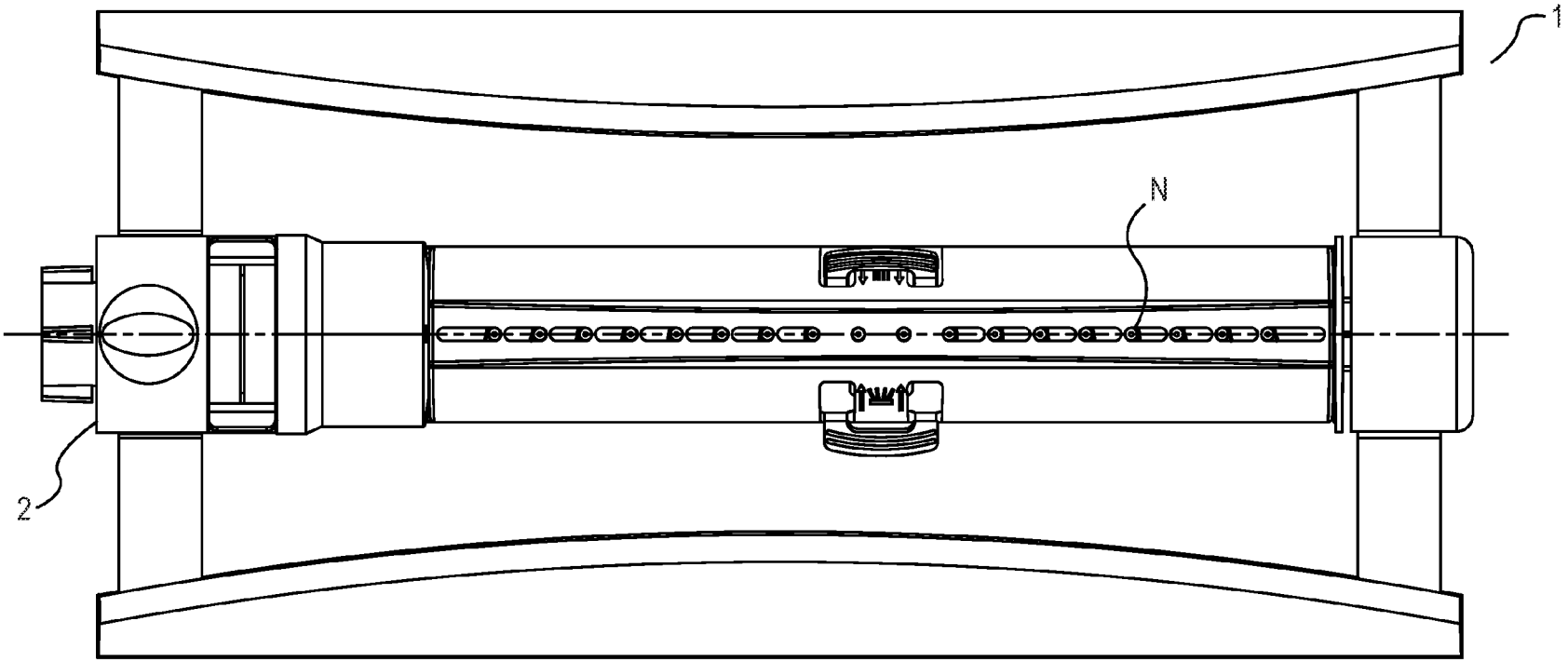
FIG. 1 shows a plan view of a sprinkler according to one embodiment of the invention.

FIG. 1 shows a plan view of an assembled, adjustable, oscillating sprinkler. Water (or any other fluid) from a water hose, for example, may be connected to fluid intake portion 2. The water is then forced through a plurality of nozzles N to the outside of the sprinkler and onto an area to be watered.

All identically numbered reference characters correspond to each other so that a duplicative description of each reference character in the following drawings will be omitted.

Figure 2:
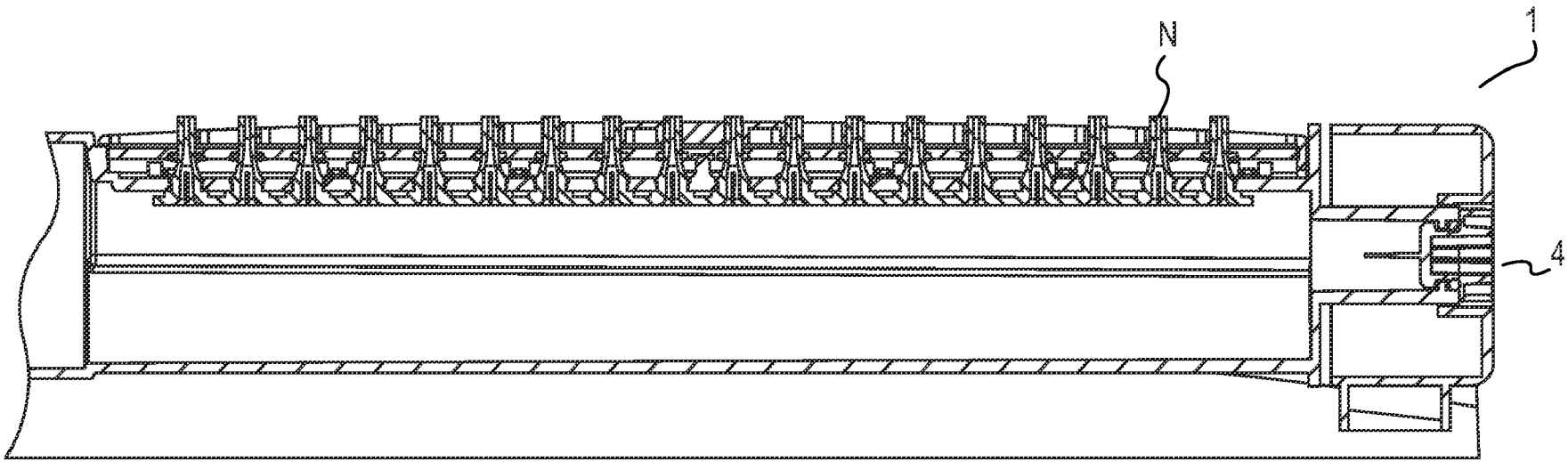
FIG. 2 shows a sectional view of the sprinkler of FIG. 1.

FIG. 2 is a sectional view of the sprinkler according to one aspect of the invention, where the nozzles N point in an upright or substantially vertical direction.

Figure 3A:
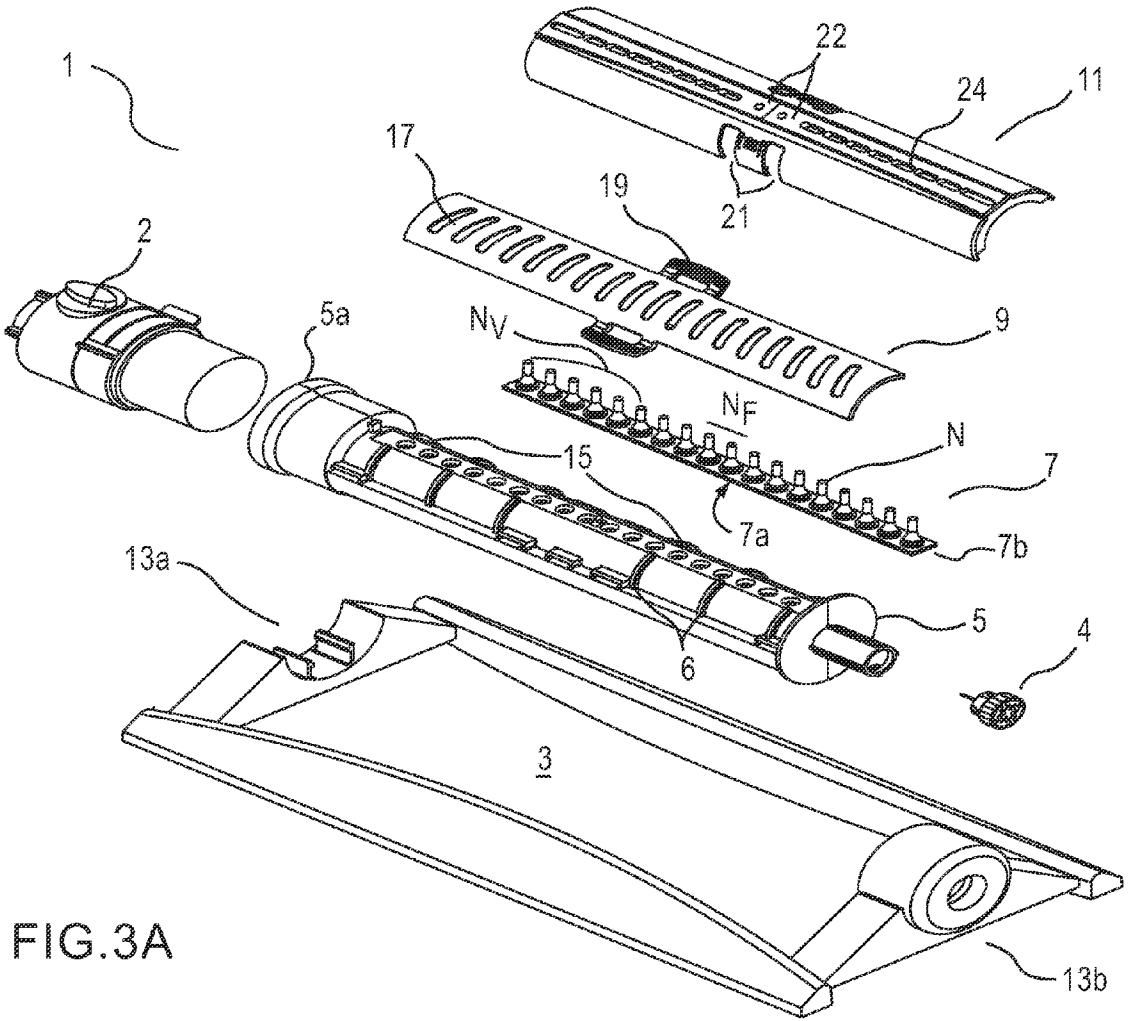
FIG. 3A shows a perspective exploded view of the sprinkler of FIG. 1.

FIG. 3A is a perspective exploded view of the sprinkler 1 shown in FIG. 1. FIG. 3A shows a housing 5 is suspended from a base frame 3, between a pair of support/connecting members 13*a* and 13*b*. Housing 5 includes a row of a plurality of inlets 15, which may be straight, provided along a longitudinal axis of housing 5. One end of housing 5 is connected to the fluid intake portion 2. Another end of housing 5 receives plug 4. Housing 5 can be rotated back and forth about the longitudinal axis by a water-operated drive (not described). Housing 5 is operably connected at a near end 5*a* to a water carrying device (e.g., hose), via a fluid intake portion 2, wherein water may pass through inlets 15. One or more elevated rib(s) 6 are formed on housing 5 and support pivot plate 9. Each of the elevated ribs 6 has a top surface and side surface.

Nozzle strip 7 may be positioned either on top of housing 5 or within housing 5. Nozzle strip 7 has a row of variable nozzles $N_v$ and one or more fixed nozzles $N_f$, each corresponding with inlets 15 provided on housing 5.

According to one aspect of the present invention, nozzle strip 7 includes a plurality of nozzles N, wherein a central nozzle and an adjacent nozzle on one or both sides of the central nozzle are fixed nozzles $N_f$ in an upright position, e.g. approximately 90° from the longitudinal axis. This structure delivers a predetermined vertical projection of water. Each of the remaining nozzles on nozzle strip 7 are variable nozzles $N_v$, each of which may be adjustably tilted outward by contact with a sidewall angle 25 (shown in FIG. 4) of pivot plate groove 17 of pivot plate 9 (further described below). Variable nozzles $N_v$ can deliver an outwardly tilted projection of water.

Nozzle strip 7 is a flexible strip (preferably made of rubber), having a plurality of nozzles N projecting upward from nozzle strip 7. When operatively positioned with respect to housing 5 and pivot plate 9, nozzles N near the center of nozzle strip 7 project upward in a substantially vertical direction, while the remaining nozzles toward the outer end 7*b* of nozzle strip 7 are progressively flared outwards.

Pivot plate 9 is an elongated curved (arcuate) plate having substantially transverse (lateral) grooves 17. Pivot plate 9 moves relative to a substantially fixed cover 11 (e.g., pivots or tilts in a circumferential direction) and has a plurality of pivot plate grooves 17, at least one pivot plate slot 20, and at least one adjusting tab 19, or any other type of appropriate adjusting element.

Pivot plate 9 extends in the longitudinal direction of the sprinkler and has a plurality of pivot plate grooves 17 extending generally transversely across the pivot plate 9. Pivot plate 9 is supported on housing 5 by ribs 6, such that pivot plate 9 is pivotable, back and forth, about housing 5 in a circumferential direction. The plurality of nozzles N, extend upward through pivot plate grooves 17 when pivot plate 9 is in position on housing 5. Cover 11 is attached to housing 5 to cover some of pivot plate 9, such that nozzles N extend into cover outlets 22 in cover 11 to allow water to be outwardly projected from the nozzles N.

The adjusting tab 19 may be formed integrally with the pivot plate 9. Pivot plate 9 may be formed of plastic or any other suitable material. Pivot plate 9 is provided on top of housing 5. Adjusting tab 19 may extend outward from a portion of the pivot plate. Pivot plate 9 is covered by cover 11. The adjusting tab 19 protrudes outward through the cover via corresponding cover slots 21 provided in cover 11. The corresponding cover slots 21 enable the adjusting tab 19 to travel a predetermined distance. The travel of the adjusting tab 19 determines a displacement of the pivot plate 9.

Figure 3B:
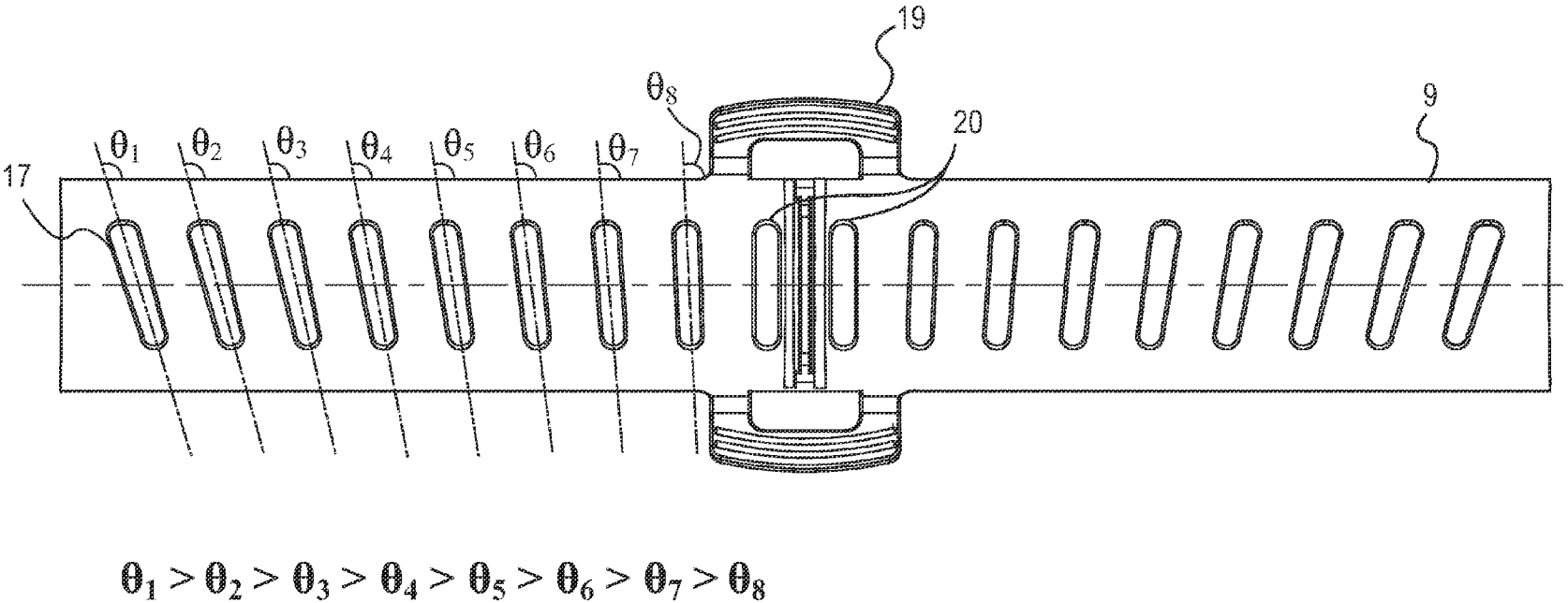
FIG. 3B shows the angles of the groove of the pivot plate of the sprinkler of FIG. 3

The number of pivot plate grooves 17 preferably corresponds to the number of variable nozzles $N_v$. Pivot plate grooves 17 are generally oblique to the longitudinal direction of pivot plate 9. Pivot plate slot(s) 20 (as shown in FIG. 3B) corresponds to each fixed nozzle $N_f$ provided in sprinkler 1. However, one slot 20 may also correspond to more than one fixed nozzle $N_f$. A pivot plate slot width or groove width is approximately equal to an external diameter of a nozzle outlet 8*b* (shown in FIGS. 7B and 7C). In the assembled state of the sprinkler, the fixed vertical nozzle(s) $N_f$ project through the corresponding straight pivot plate slots 20 and the variable nozzles $N_v$ project through the corresponding pivot plate grooves 17.

Cover 11 is attached to the housing 5 and has a circular cover outlet 22 corresponding to each fixed vertical nozzle $N_f$ in the sprinkler 1, a plurality of rectangular cover grooves 24 that are substantially parallel to the longitudinal axis of the sprinkler 1, and cover slots 21 associated with each adjusting tab 19. The cover 11 and the pivot plate 9 are superimposed so that in the assembled state, the nozzles N extend outside the cover 11 and away from the housing of the sprinkler 1. The overlapping of the pivot plate grooves 17 and the cover grooves 24 define an intersection area, which provides a protruding space for the nozzles N. The shape of the pivot plate grooves 17 determines the tilting position of the variable nozzles $N_v$ and therefore the sprinkling pattern. For example, if the adjusting tab 19 is in an extreme upward position (e.g., as shown in the top drawing of FIGS. 8 and 9A), the corresponding intersection area will tilt the nozzle outlets 8*b* outward and deliver water outward.

As shown in FIG. 3B, pivot plate grooves 17 incrementally become less parallel with the pivot plate slots 20 as pivot plate grooves 17 get further away from the pivot plate slots 20. This progressive increasing of the difference in the angles of the pivot plate grooves allows for a consistent and uniform sprinkler spray pattern. As variable nozzles $N_v$ get manipulated by pivot plate grooves 17, the variable nozzles point in a more outward direction the further away the grooves 17 are located from the center of the pivot plate 9.

As shown in FIG. 4A-4D, pivot plate 9 includes pivot plate grooves 17 that have angled sidewalls 25. The sidewalls 25 of the pivot plate grooves 17 are formed with an angle so that when variable nozzles $N_v$ are moved, the axis of each of the variable nozzles remains substantially parallel to the portion of the sidewall of respective pivot plate groove 17 that is in contact with the variable nozzle $N_v$.

The degree of the angle of the sidewall 25 progressively increases along the length of the groove (discussed in detail below). This allows a greater surface area of the sidewall to contact the flexible variable nozzle $N_v$ which helps to prevent the variable nozzles $N_v$, from being squeezed or pinched by the sidewalls of the pivot plate grooves 17. It also increases the life expectancy of the nozzles by reducing wear that may be caused by the pivot plate grooves 17 contacting the variable nozzles $N_v$.

Figure 4A:
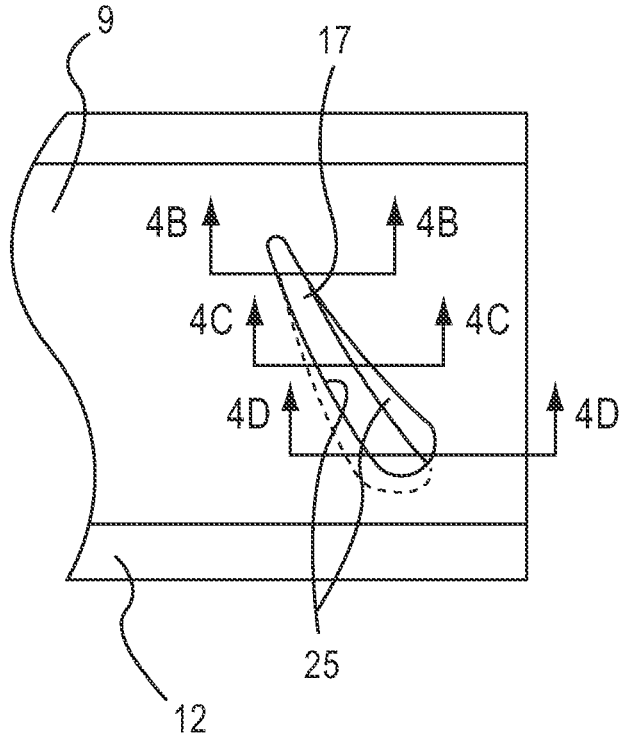
FIGS. 4A, 4B, 4C and 4D show a sectional view of a sidewall of a groove of a pivot plate of the sprinkler of FIG. 1.
Figure 4B:
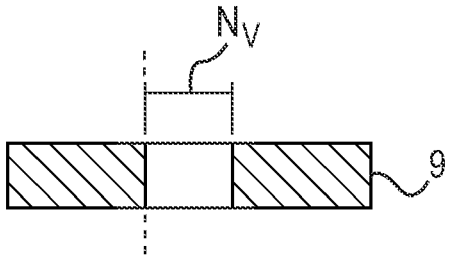
Figure 4C:
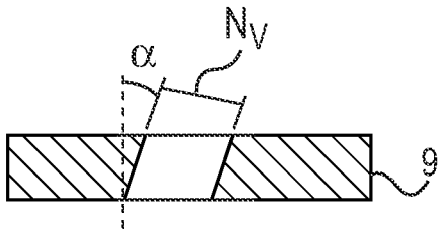
Figure 4D:
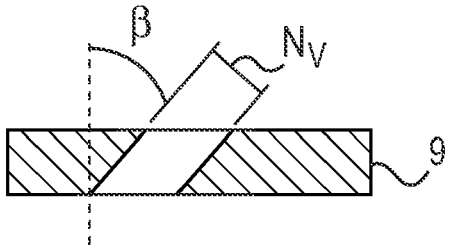

FIG. 4A shows a groove 17 from the bottom perspective. As shown in FIGS. 4B-4D, the angle of sidewall 25 increases. As can be seen from FIG. 4, $\alpha_1<\alpha_2<\alpha_3$. Variable nozzle $N_v$ is progressively titled outward as sidewall 25 contacts and moves the variable nozzle. As pivot plate 9 is pivoted, the angle of sidewall 25 remains substantially parallel to the tubular part of variable nozzle $N_v$.

Figure 5:
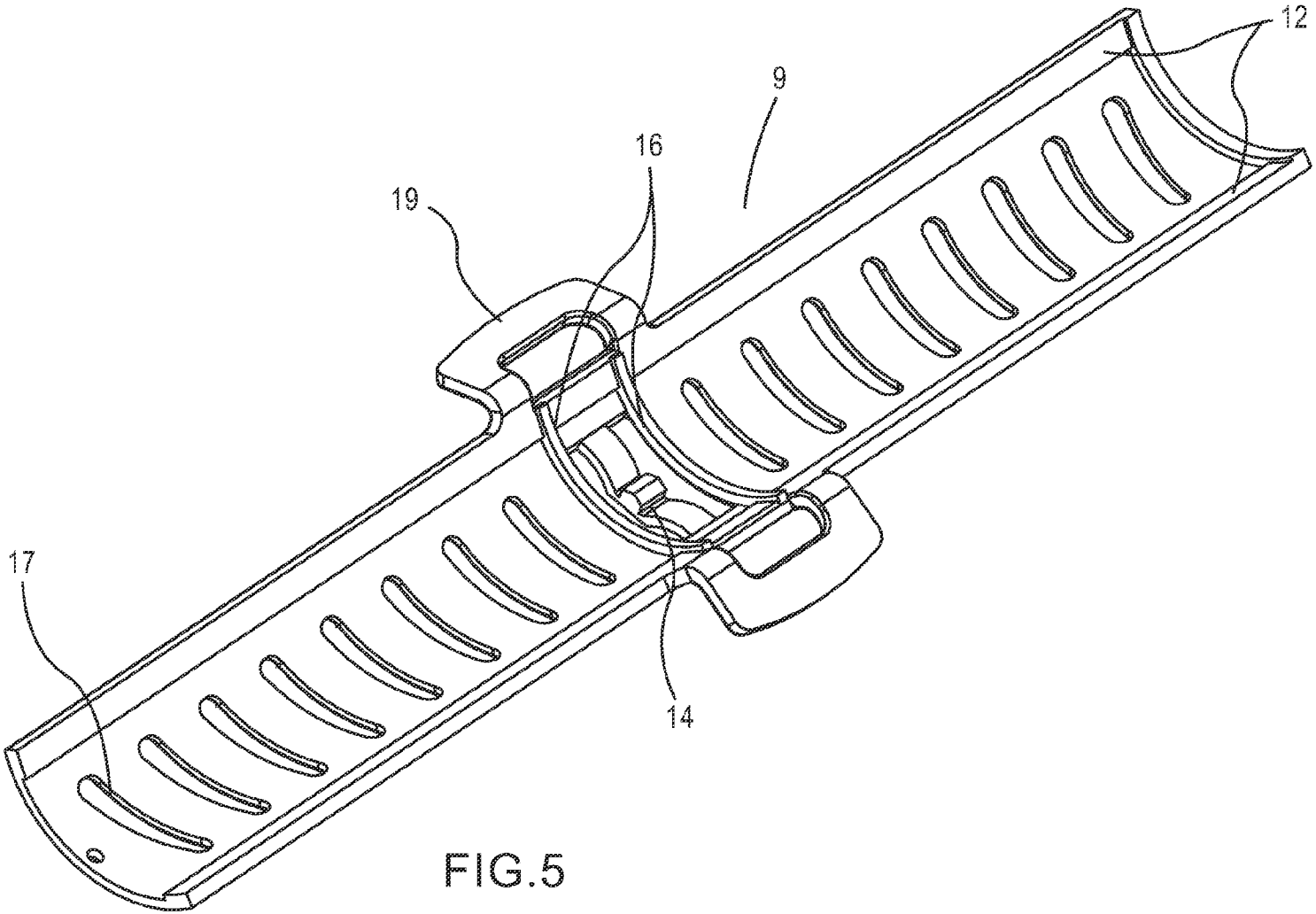
FIG. 5 shows a bottom view of the pivot plate of the sprinkler of FIG. 1.

As shown in FIG. 5, pivot plate 9 includes at least one internal rib 16 (preferably two), provided on the bottom (or underside) of pivot plate 9. The internal rib(s) 16 allow the pivot plate to slide along the tubular housing itself. The internal ribs 16 also serve to substantially fix pivot plate 9 in place with respect to any longitudinal movement about tubular housing 5 by contacting the side surface of elevated ribs 6 provided on the tubular housing 5.

Figure 6:
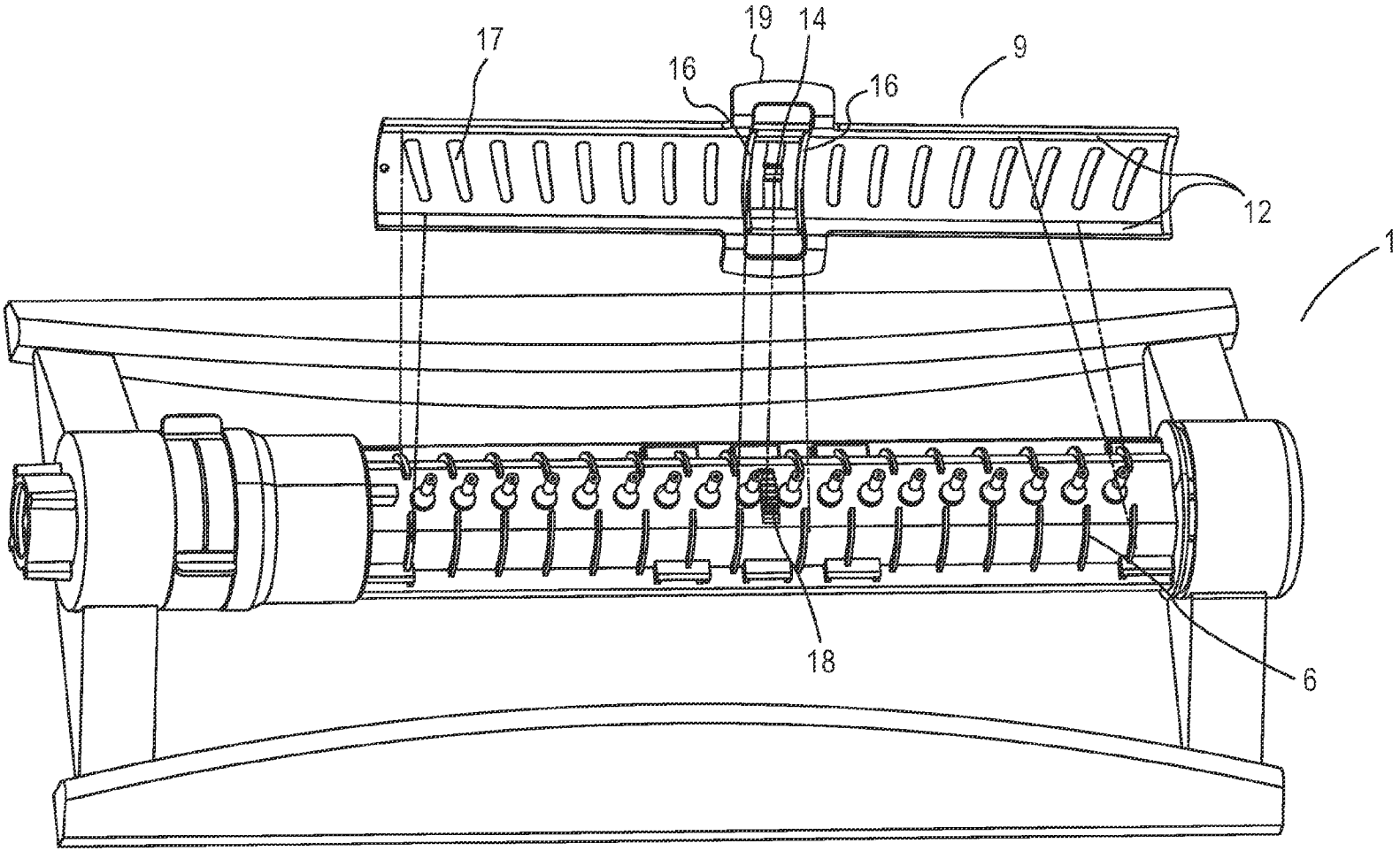
FIG. 6 shows a perspective exploded view of the pivot plate and tubular housing of FIG. 1.

Pivot plate 9 may also have at least one elevated rail 12 located on one or both sides of the longitudinal axis of pivot plate 9 as shown in FIG. 5 (also shown in FIG. 6). The elevated rail(s) 12 contacts the top surface of elevated ribs 6 of tubular housing 5. This allows pivot plate 9 to move more easily over the tubular housing 5 and elevated ribs 6 of the tubular housing 5.

Wedge 14 is formed on an underside of pivot plate 9 and cooperatively engages a plurality of notches 18 provided on housing 5. The wedge 14 and notches 18 allow the user to adjust the position of pivot plate 9 to one of several positions by actuating adjusting tab 19. As the user adjusts tab 19, the wedge 14 is moved over and into the notches 18 located on housing 5. A lateral force is all that is needed for the wedge 14 to be moved to a different position.

As shown in FIG. 6, two internal ribs 16 of pivot plate 9 fit in between two elevated ribs 6 of tubular housing 5. A side surface of two internal ribs 16 contact (or come into close proximity) the side surface of elevated ribs 6. Housing 5 may also contain a notch-shaped element 18. This element is designed to be used with wedge 14. As the wedge is moved via adjusting tab 19, it is positioned into different notches of notch-shaped element 18. This allows a user to set a precise position of the adjusting tab and to also set a precise, repeatable and pre-determined spray pattern of sprinkler 1.

Figure 7C:
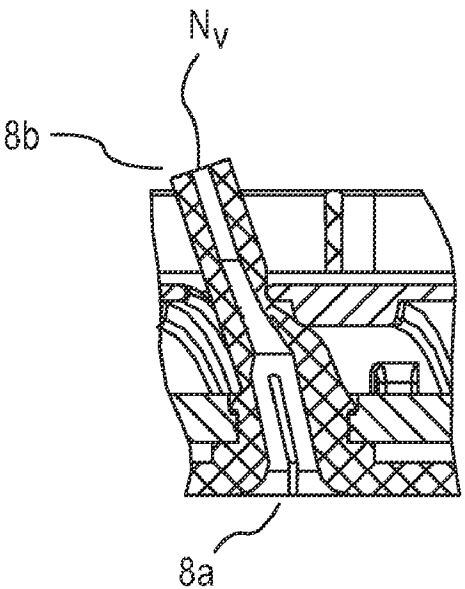
FIGS. 7A, 7B and 7C show a sectional assembled view along an x-axis and y-axis of the sprinkler shown in FIG. 1.
Figure 7B:
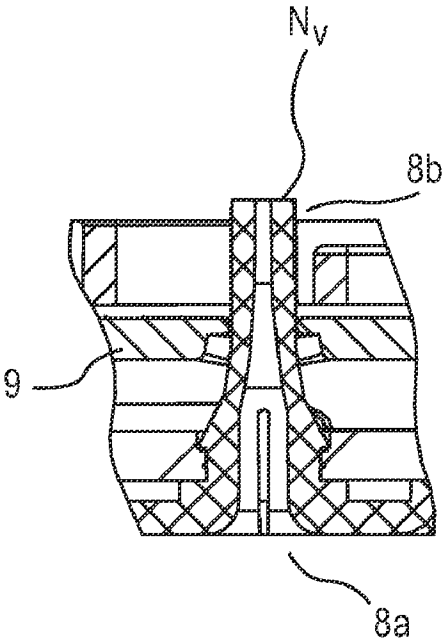
Figure 7A:
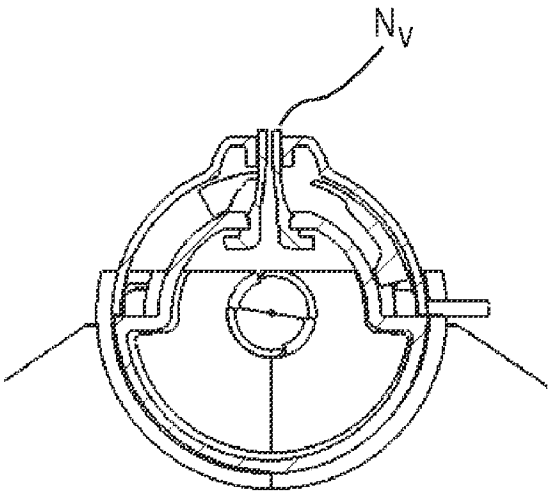

As shown in FIGS. 7A, 7B and 7C, each variable nozzle $N_v$ has an inlet 8*a* and an outlet 8*b* (following a substantially cylindrical portion), wherein the outlet 8*b* passes through pivot plate grooves 17 of pivot plate 9. Variable nozzles $N_v$ may be rubber-like so that the nozzle outlets 8*b* can be tilted or bent in a desired position.

Figure 8:
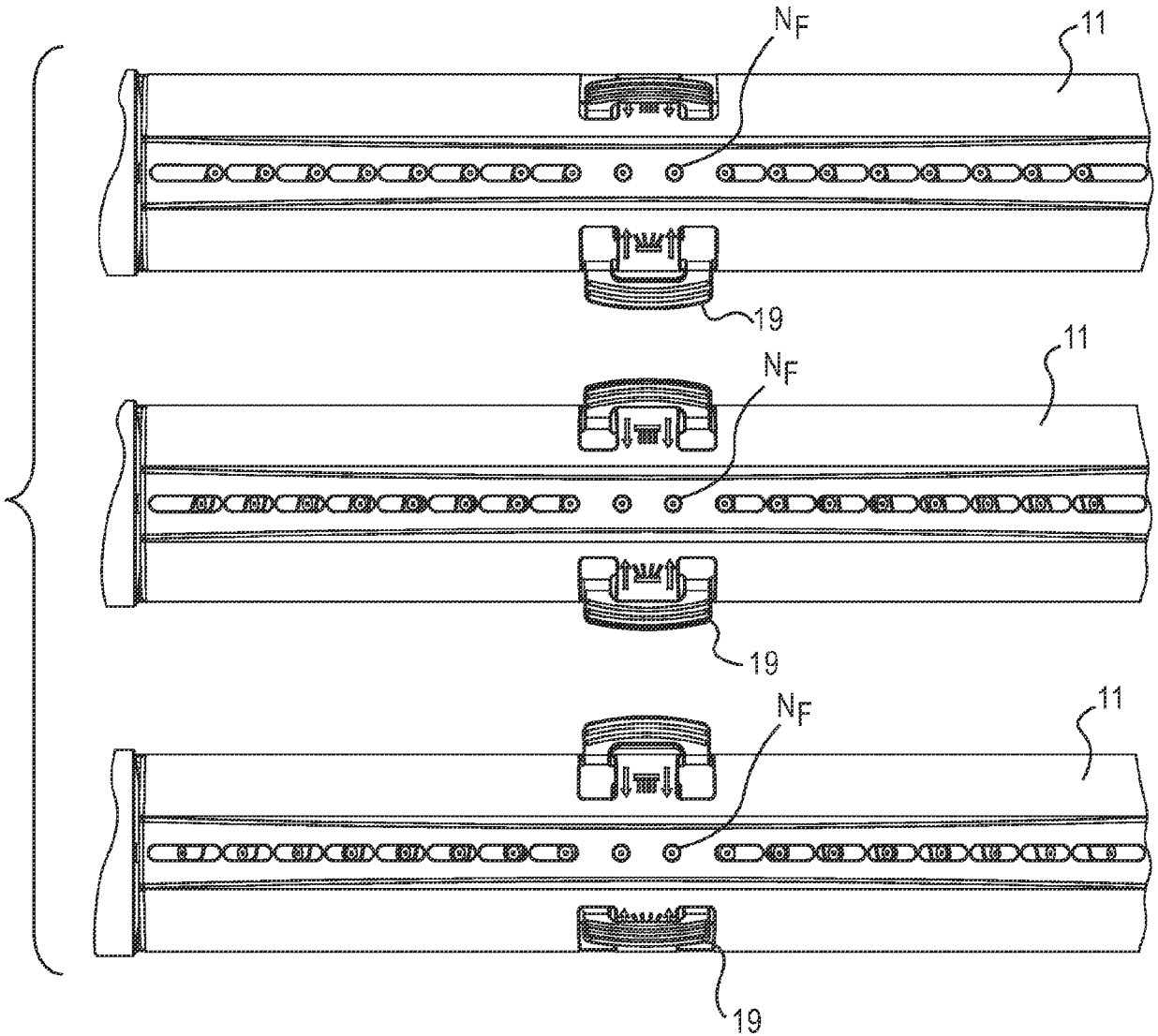
FIG. 8 shows an assembled view of several different settings of the sprinkler of FIG. 1.

FIG. 8 shows an assembled view of three different settings of the adjusting tab 19 of sprinkler 1. In the first setting (top) adjusting tab 19 is not adjusted. As a result, variable nozzles $N_v$ point in a substantially vertical direction. In the second setting (middle) adjustable element 19 is partially adjusted. As a result, variable nozzles $N_v$ point in a somewhat outwardly direction. As the nozzles N are positioned further away from the center of pivot plate 9, they become increasingly angled with respect to the center fixed nozzles, $N_f$. In the third setting (bottom) adjustable tab 19 is fully adjusted. As a result, variable nozzles $N_v$ are fully tilted outward and the sprinkling pattern is set to its maximum coverage.

Figure 9A:
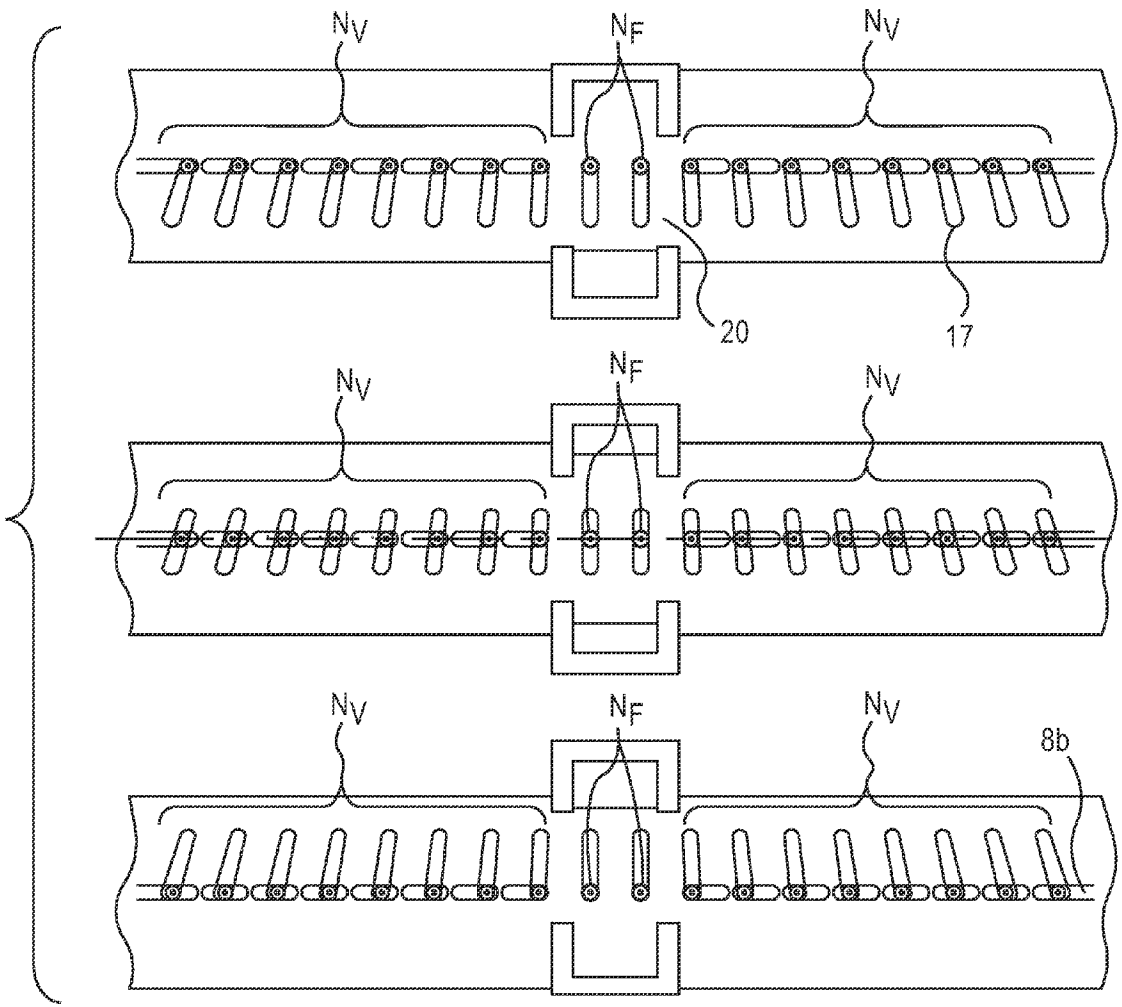
FIGS. 9A and 9B show a sectional view of the different settings of the pivot plate and the corresponding spray pattern respectively, of the sprinkler of FIG. 1.
Figure 9B:
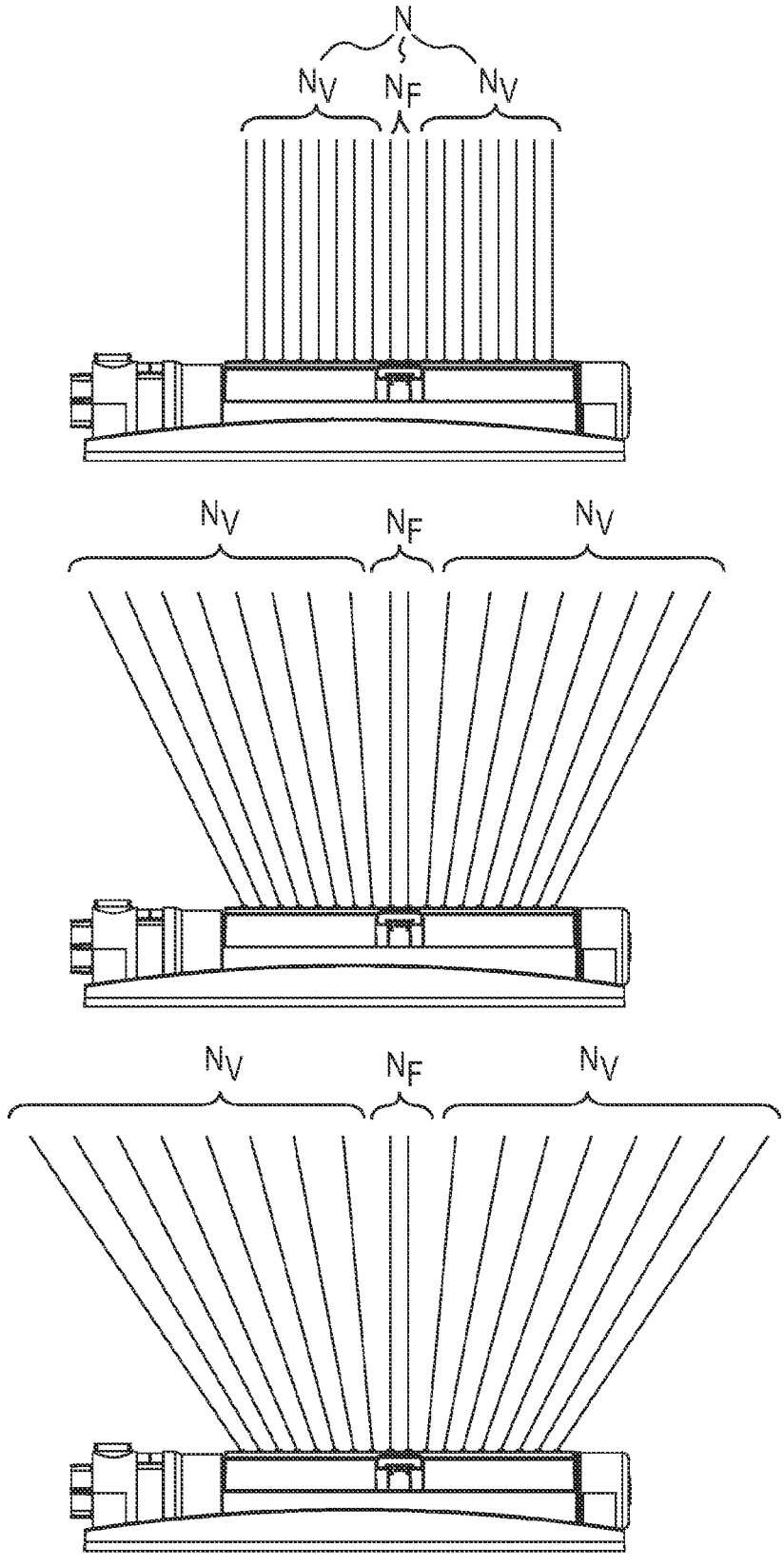

FIGS. 9A and 9B show the angle of fixed nozzles $N_f$, the angle of the variable nozzles $N_v$, as well as the corresponding sprinkling pattern, respectively. As shown in FIG. 9B, the inner variable nozzles $N_v$ tilt less than the outer variable nozzles $N_v$ so that a uniform sprinkling pattern (e.g. fan-like) may be achieved. As shown in FIG. 9B, fixed nozzles $N_f$ always point in a fixed direction, in this case a substantially vertical direction.

Figure 10:
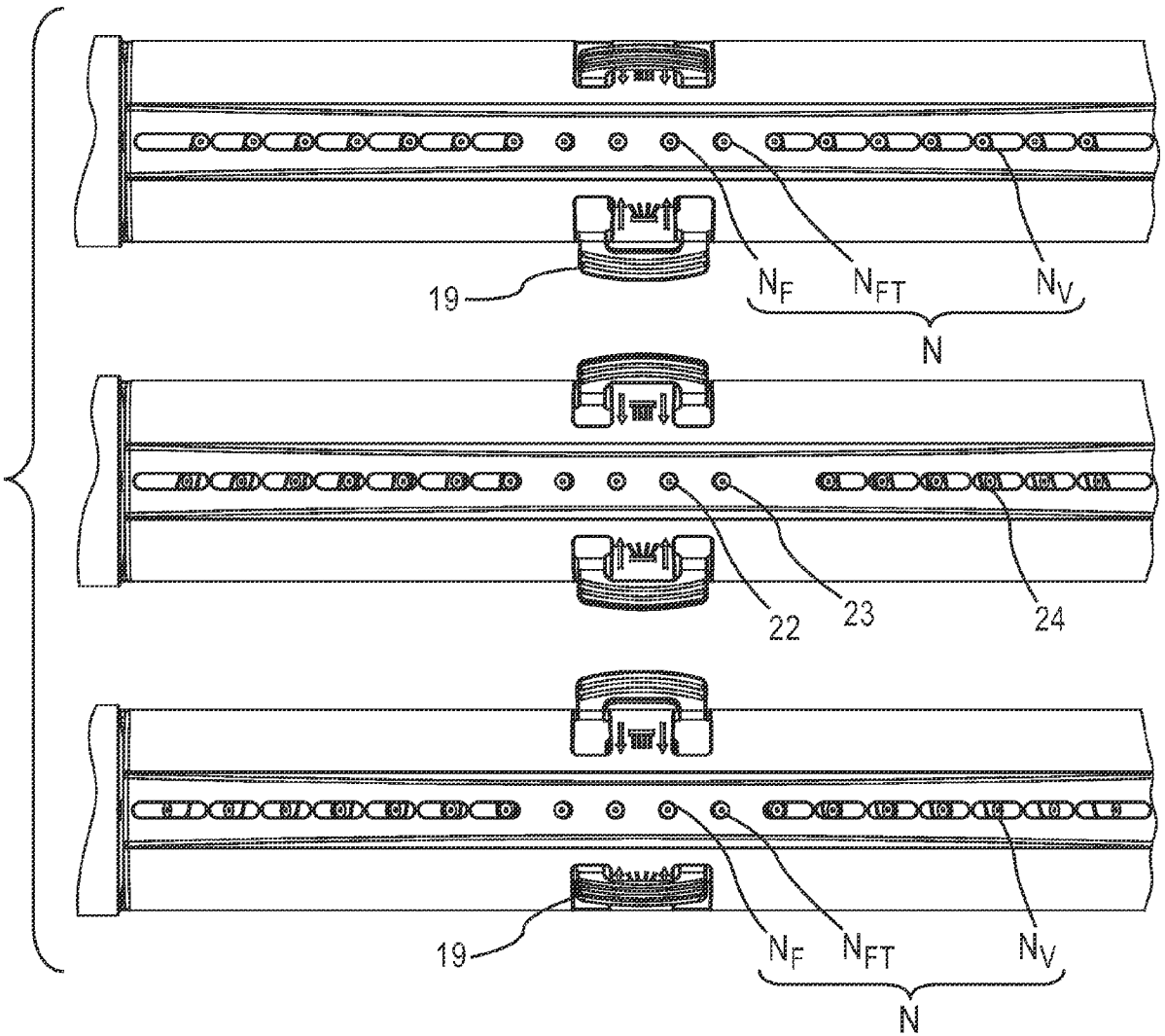
FIG. 10 shows an assembled view of the different settings according to another embodiment of the invention.

FIG. 10 shows another embodiment of the present invention. In FIG. 10, four fixed nozzles $N_f$ are located at the center of the sprinkler. The inner two fixed nozzles $N_f$ point in a substantially vertical direction, approximately 90° perpendicular to the surface of cover 11. The inner two fixed nozzles $N_f$ protrude through substantially vertical circular cover outlet 22. The outer two fixed nozzles $N_{ft}$ are fixed in a tilted outward position. The three drawings of FIG. 10 show the different angles of the variable nozzles $N_v$ as adjusting tab 19 is being adjusted, similar to that shown in FIG. 8.

A plurality of nozzles adjacent to both sides of the fixed vertical nozzle(s) $N_f$ may be fixed in a desired tilted position $N_{ft}$, (e.g., less than 90° from the longitudinal axis) by the predetermined desired position of angled cover outlets 23 of the cover 11. This structure delivers a predetermined vertical and fan-like projection of fluid. The remaining nozzles in this arrangement are variable $N_v$ and may be adjustably tilted outward (described above) so that variable nozzles $N_v$ deliver a selectively outward tilted projection of fluid.

Figure 11A:
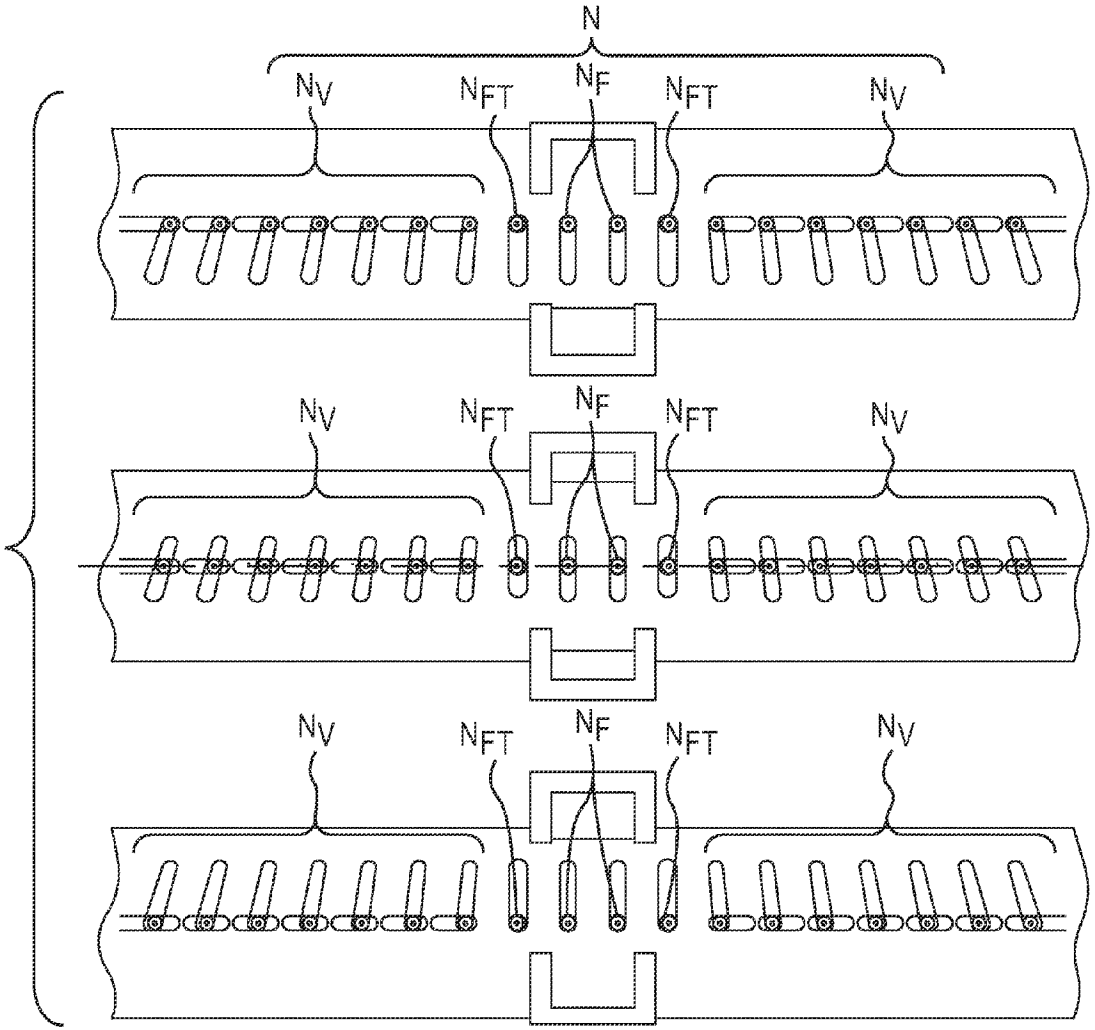
FIGS. 11A and 11B show a sectional view of the different settings of a pivot plate and the corresponding spray pattern respectively of the embodiment of FIG. 10.
Figure 11B:
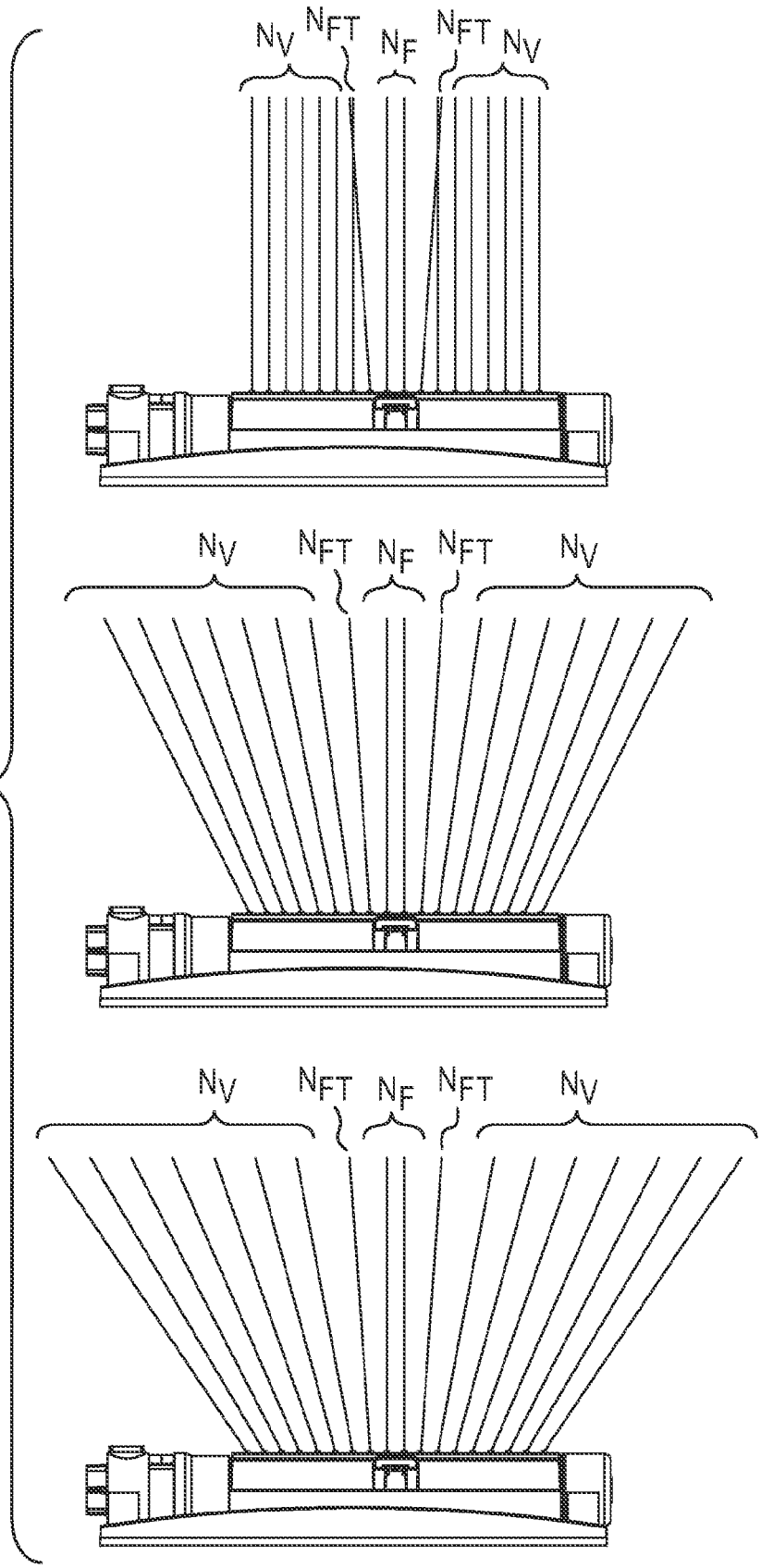

FIGS. 11A and 11B show the angle of fixed nozzles $N_f$ as well as the angle of the variable nozzles $N_v$ as well as the corresponding sprinkling pattern, respectively. As shown in FIG. 11B, the inner variable nozzles $N_v$ tilt less than the outer variable nozzles $N_v$ so that a uniform sprinkling pattern may be achieved. As shown in FIG. 11B, fixed nozzles $N_f$ always point in a fixed direction, in this case the inner fixed nozzles point in a substantially vertical direction, while the outer fixed nozzles $N_{ft}$ point in a tilted direction.

Figure 12A:
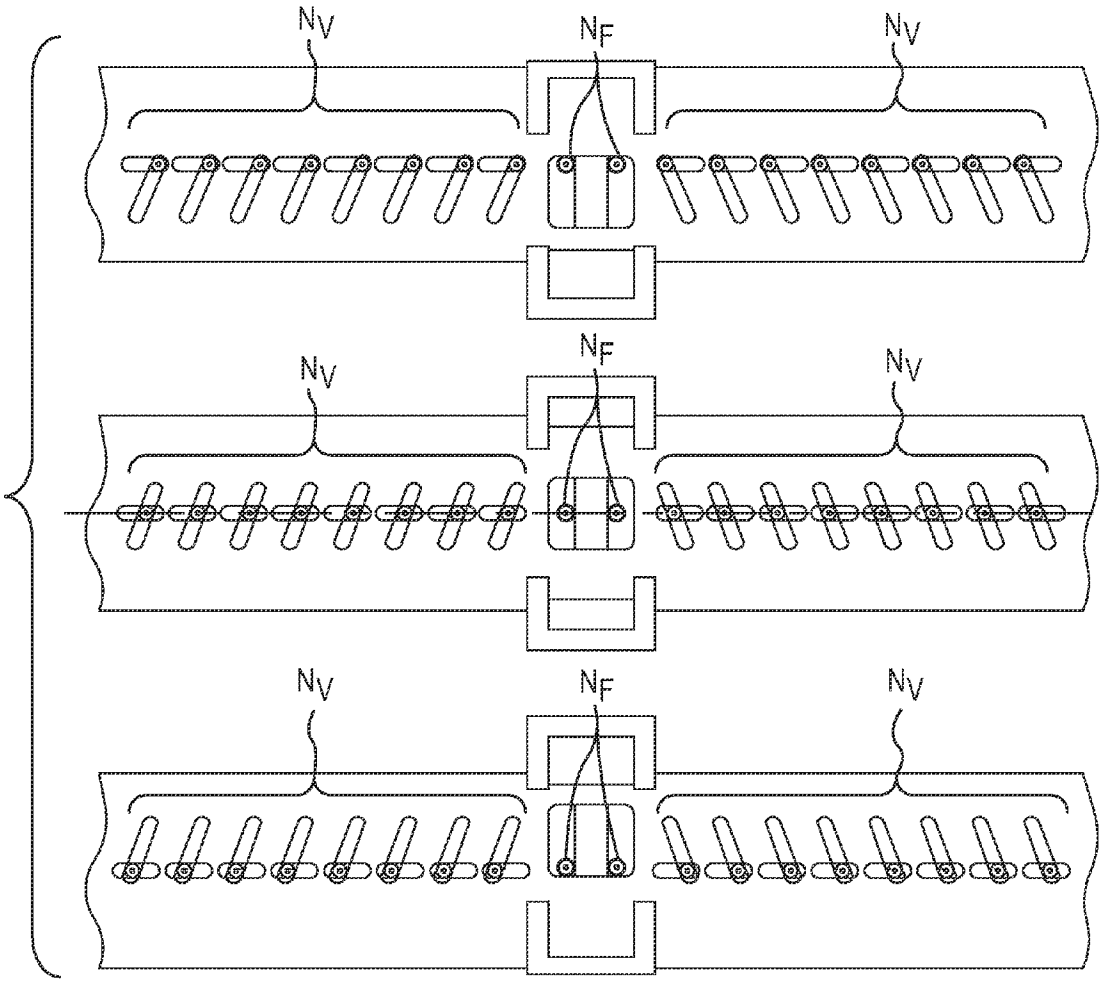
FIGS. 12A and 12B show a sectional view of the different settings of a pivot plate and the corresponding spray pattern respectively according to another embodiment of the invention.
Figure 12B:
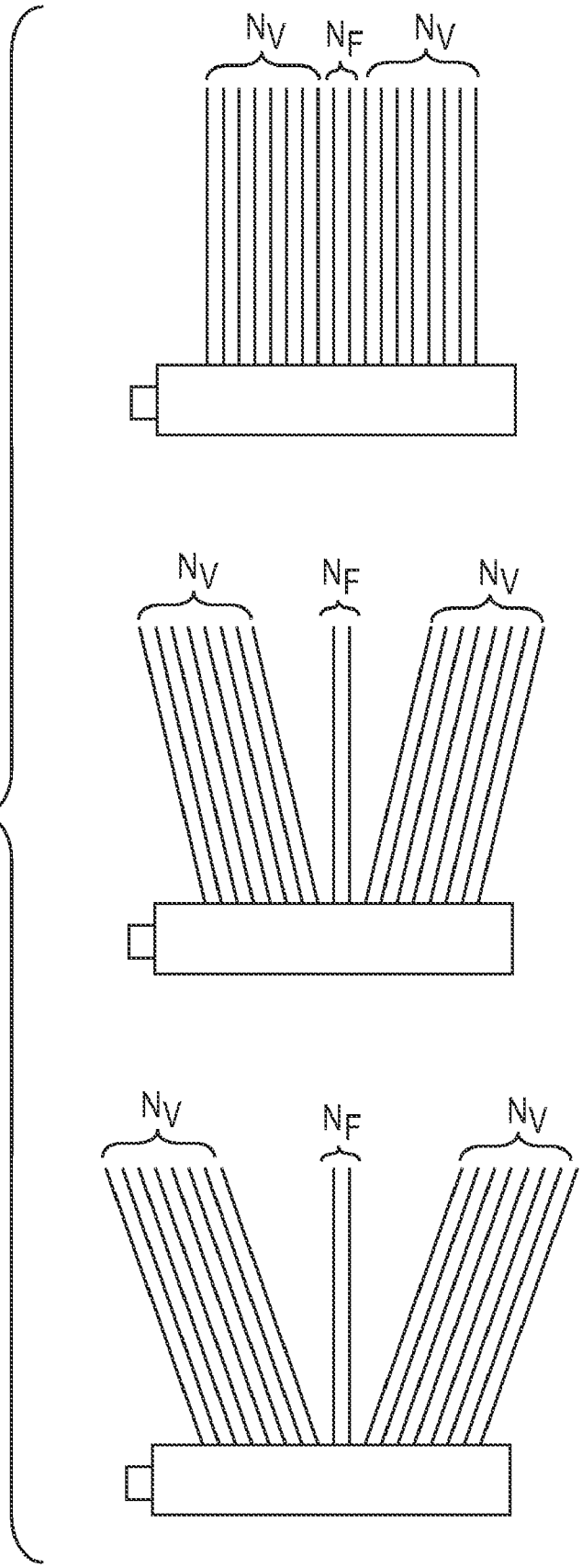

In another embodiment, FIGS. 12A and 12B show the angle of fixed nozzles $N_f$, the angle of the variable nozzles $N_v$ as well as the corresponding sprinkling pattern, respectively. As shown in FIG. 12B, the inner variable nozzles $N_v$ move the same amount as the outer variable nozzles $N_v$. Thus, the variable nozzles $N_v$ do not move relative to each other. As shown in FIG. 12B, fixed nozzles $N_f$ always point in a fixed direction, in this case in a substantially vertical direction. As variable nozzles $N_v$ do not move relative to one another, the streams of fluid from the variable nozzles leave the sprinkler parallel to each other.

Figure 13:
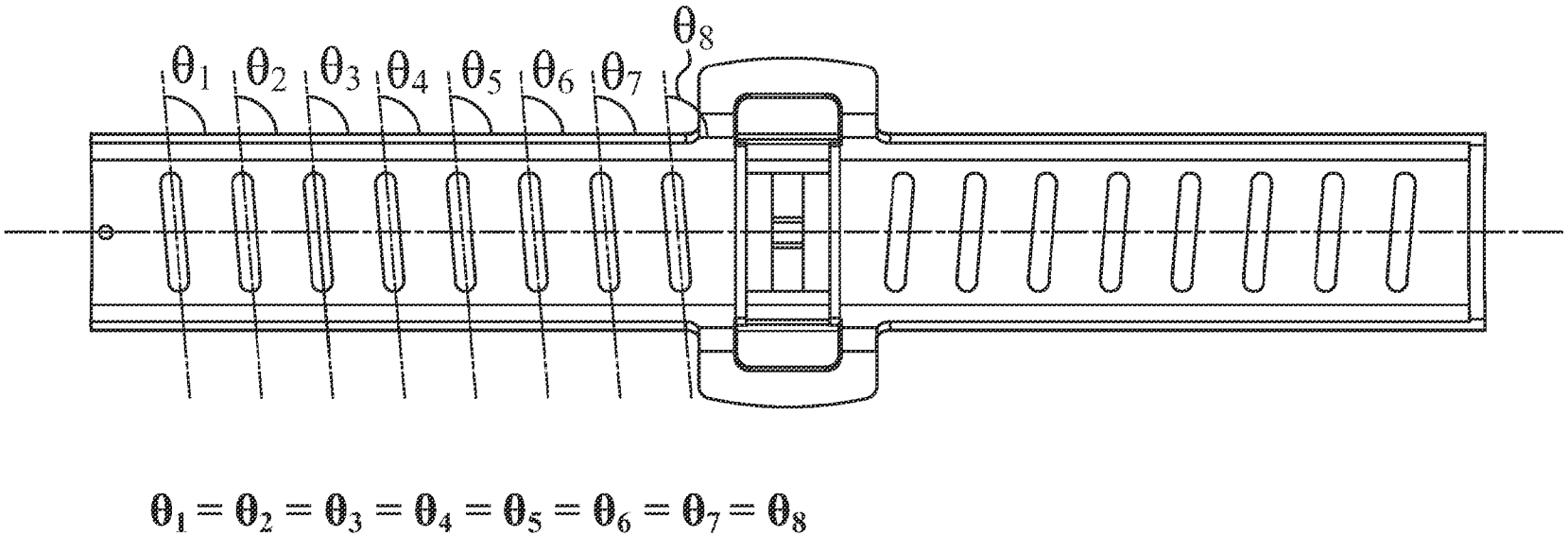
FIG. 13 shows the angle of the groove of the pivot plate of the sprinkler of FIG. 12.

As shown in FIG. 13, pivot plate grooves 17 are set at a predetermined fixed angle θ. With each pivot plate groove set at the same angle relative to the longitudinal axis of the pivot plate 9, each of the variable nozzles $N_v$ move parallel to each other and thus do not move relative to one another.

Although specific embodiments of the invention have been disclosed, it will be understood by those having skill in the art that changes can be made to those specific embodiments without departing from the spirit and the scope of the invention.

I claim:

1. A sprinkling apparatus comprising:

a generally rectangular shaped frame;

a generally tubular shaped housing rotatably attached to said frame;

a water operated drive attached to said tubular shaped housing;

said water operated drive having a fluid intake portion;

a nozzle strip in contact with said tubular housing, wherein said nozzle strip has a plurality of nozzles;

a pivot plate in contact with said nozzle strip and said tubular housing, wherein said pivot plate comprises an adjusting tab and a plurality of grooves, wherein said plurality of nozzles protrude through said grooves of said pivot plate, wherein said adjusting tab is approximately located in a center of said pivot plate in a lengthwise direction and pivots the pivot plate in a circumferential direction with respect to a longitudinal direction of said housing, wherein an axis of at least some of said plurality of nozzles is varied as the pivot plate is rotated;

a cover connected to said tubular housing, said cover comprises cover slots and cover grooves, wherein said adjusting tab protrudes through said cover slots and said nozzles protrude through said cover grooves.

2. The sprinkling apparatus according to claim 1 wherein an angle of at least some of said pivot plate grooves varies with respect to the angle formed between the pivot plate grooves and the longitudinal axis of said pivot plate.

3. The sprinkling apparatus according to claim 1 wherein at least one of said nozzles is fixed in a substantially vertical direction.

4. The sprinkling apparatus according to claim 1, wherein said pivot plate grooves increasingly slant outward with respect to a middle portion of said pivot plate.

5. The sprinkling apparatus according to claim 1 wherein said adjusting tab comprises a pair of tabs formed one each on an opposing side of said pivot plate.

6. The sprinkling apparatus according to claim 1, wherein said tubular housing has at least one elevated rib, wherein said elevated rib supports said pivot plate.

7. The sprinkling apparatus according to claim 1, wherein some of said plurality of nozzles of said nozzle strip incrementally flare outward as said nozzles increase in distance from a center of said nozzle strip.

8. The sprinkling apparatus according to claim 1, wherein said cover grooves further comprise generally circular cover outlets, where said nozzles protrude through said cover outlets.

9. The sprinkling apparatus according to claim 8, wherein a width of said cover grooves is approximately equal to a width of corresponding said nozzles.

10. The sprinkling apparatus according to claim 1 wherein a diameter of said circular cover grooves are approximately equal to an outer diameter of said nozzles, wherein said circular cover outlets limit movement of said corresponding nozzles in a lateral direction.

11. The sprinkling apparatus according to claim 4, wherein said grooves comprise a sidewall having an angled surface so that a sidewall of said groove remains substantially parallel to a nozzle axis as said sidewall moves the nozzle axis.

12. An oscillating sprinkler apparatus having a frame, a tubular housing attached to the frame and a pivot plate sliding on said tubular housing, wherein said pivot plate guides adjustable nozzles in said sprinkler, wherein said pivot plate comprises:

a series of apertures, wherein each of said apertures is formed with an incrementally increasing angle with respect to a lengthwise centerline of said pivot plate so that as each of said adjustable nozzles is tilted by a sidewall of said aperture, said sidewall remains substantially parallel to a cylindrical portion of said nozzle, wherein said pivot plate has an adjusting tab located in the center of said pivot plate in a lengthwise direction.

13. A sprinkling apparatus comprising:

a frame;

a housing rotatably attached to said frame;

a nozzle strip attached to said housing, a pivot plate in contact with said nozzle strip and said housing, wherein said pivot plate comprises a plurality of grooves, wherein said pivot plate has an adjusting tab located in the center of said pivot plate in a lengthwise direction, wherein said pivot plate pivots in a circumferential direction with respect to a longitudinal direction of said housing, wherein an axis of at least some of a plurality of nozzles of said nozzle strip are varied as the pivot plate is rotated.

14. The sprinkling apparatus according to claim 13, wherein an angle of at least some of said pivot plate grooves varies with respect to the angle formed between the pivot plate grooves and the longitudinal axis of said pivot plate.

15. The sprinkling apparatus according to claim 13, wherein at least one of said nozzles is fixed in a substantially vertical direction.

16. The sprinkling apparatus according to claim 13, wherein said pivot plate grooves increasingly slant outward with respect to a middle portion of said pivot plate.

17. The sprinkling apparatus according to claim 13 wherein said adjusting element is located on opposite sides of said pivot plate.

18. The sprinkling apparatus according to claim 13, wherein said tubular housing has at least one elevated rib, wherein said elevated rib supports said pivot plate.

19. The sprinkling apparatus according to claim 13, wherein some of said plurality of nozzles of said nozzle strip incrementally flare outward as said nozzles increase in distance from a center of said nozzle strip.

* * * * *